US005176267A

United States Patent [19]

Pech

[11] Patent Number: 5,176,267

[45] Date of Patent: Jan. 5, 1993

[54] QUICK DISCONNECT SYSTEM FOR CONSTRUCTION EQUIPMENT WITH ROTATABLE UPPER WORKS

[75] Inventor: David Pech, Manitowoc, Wis.

[73] Assignee: The Manitowoc Company, Inc., Manitowoc, Wis.

[21] Appl. No.: 556,840

[22] Filed: Jul. 23, 1990

[51] Int. Cl.[5] ..... B66C 23/26

[52] U.S. Cl. ..... 212/180; 212/229; 212/253

[58] Field of Search ..... 212/175, 176, 177, 178, 212/179, 180, 181, 253, 247; 384/591, 592, 593, 229; 248/680, 681

[56] References Cited

U.S. PATENT DOCUMENTS

| | | | |
|---|---|---|---|
| 1,941,753 | 1/1934 | Plies | 248/680 |
| 2,313,084 | 3/1943 | Manly . | |
| 2,965,245 | 12/1960 | Zeilman et al. . | |
| 3,125,226 | 3/1964 | Mork et al. . | |
| 3,139,198 | 6/1964 | Penney et al. . | |
| 3,726,418 | 4/1973 | Short . | |
| 3,921,817 | 11/1975 | Petrik et al. | 212/181 |
| 3,923,407 | 12/1975 | Jensen et al. . | |
| 3,941,252 | 3/1976 | Six et al. . | |
| 4,231,699 | 1/1980 | Thompson | 212/247 |
| 4,248,488 | 2/1981 | Sable . | |
| 4,266,679 | 5/1981 | Juergens | 212/181 |
| 4,332,328 | 6/1982 | Otto et al. | 212/180 |
| 4,436,444 | 3/1984 | Scherrer . | |
| 4,478,340 | 10/1984 | Delago . | |
| 4,622,860 | 11/1986 | Cametti et al. . | |

FOREIGN PATENT DOCUMENTS

| | | | |
|---|---|---|---|
| 2434376 | 6/1975 | Fed. Rep. of Germany | 212/253 |
| 7804546 | 10/1978 | Netherlands | 212/253 |
| 393194 | 12/1973 | U.S.S.R. | 212/175 |
| 670528 | 6/1979 | U.S.S.R. | 212/229 |
| 965976 | 10/1982 | U.S.S.R. | 212/229 |
| 1212925 | 2/1986 | U.S.S.R. | 212/229 |
| 1392019 | 4/1988 | U.S.S.R. | 212/177 |

OTHER PUBLICATIONS

Article entitled, "Solving The Quick-Disconnect Problem For Big Bearings", *Machine Design*, Jul. 7, 1983, pp. 91-95.

Brochure entitled, "Manitowoc 3950D Dragline", 8 pages, published 1985.

Brochure entitled, "Manitowoc 4100W", 8 pages, published 1972.

*Primary Examiner*—Sherman Basinger
*Assistant Examiner*—Thomas J. Brahan
*Attorney, Agent, or Firm*—Willian Brinks Olds Hofer Gilson & Lione

[57] ABSTRACT

A quick disconnect system for a piece of construction equipment having an upper works rotatably mounted on a lower works, such as a crane, is disclosed. The system includes an adapter plate to which preferably the upper works is releasably connected, such as by pinned links. The adapter plate and preferably the lower works may then be maintained as a unit with a swing bearing therebetween even when the upper works is removed for easy transportation of the equipment. When used with a conventional swing bearing, having an inner race and an outer race, the inner race may be bolted to the lower works and the outer race may be bolted to the adapter plate.

16 Claims, 7 Drawing Sheets

QUICK DISCONNECT SYSTEM FOR CONSTRUCTION EQUIPMENT WITH ROTATABLE UPPER WORKS

BACKGROUND OF THE INVENTION

The present invention relates to construction equipment, such as cranes, having an upper works rotatably mounted on a lower works, and more particularly to an apparatus for permitting a quick separation and assembly of the lower works and upper works.

The problem addressed by the present invention is described in an article entitled "Solving The Quick-Disconnect Problem For Big Bearings" in the Jul. 7, 1983 issue of *Machine Design.*

Construction equipment, such as cranes or excavators, often must be moved from one job site to another. Moving a crane or excavator can be a formidable task when the machine is large and heavy. For example, highway limits on vehicle-axle loads must be observed and overhead obstacles can dictate long, inconvenient routings to a job site.

One solution to improving the mobility of large construction machines is to disassemble them into smaller, more easily handled components. For example, the upper rotating structure of a crane with a large-diameter, swing bearing can be removed from the mobile lower works. Because most swing bearings have at least one bolted interface, the machine can be taken down into more manageable sections for transport.

The disassembly of a crane with a conventional bearing having an inner race and an outer race is both labor-intensive and time-consuming, making it a costly undertaking. The disassembly of numerous high-strength fasteners is one factor that impedes rapid undecking of machines As an example, a 200-ton lifting crane with a 100-in. (pitch-diameter) swing bearing may have 70 or more bolts in one or both bearing rings. To disconnect and reassemble the bearing, all the bolts in one of the bearing rings must be disassembled, replaced, and uniformly torqued to a high preload.

Machine disassembly can cause alignment difficulties as well. For instance, the bearing bolt holes must be aligned precisely with mounting-surface holes in the reassembly of a machine. Because the machine parts are large and heavy, such alignments can be unwieldy and time-consuming. Moreover, if the disconnect is made at the outer bearing ring (most often the ring fixed to the machine rotating structure), then the swing bearing drive also must be critically aligned during machine assembly to minimize backlash and attendant shock loading from slewing motion.

The *Machine Design* article discloses a number of machine designs, many of which are patented, that have been developed to overcome these problems. For examples of previously patented approaches to solving this problem, see U.S. Pat. Nos. 4,478,340; 4,436,444; 4,248,488; 3,941,252; 3,923,407; 3,921,817; 3,726,418 and 2,965,245.

Many of the previously patented devices have the disadvantages that they are expensive. Also, the configurations are seldom interchangeable with standard bearings. Further, in many cranes, the upper works is the heaviest part of the disassembled crane, and is therefore the limiting element in the transportability of the crane. Thus, a quick disconnect system should preferably not add weight to the upper works.

SUMMARY OF THE INVENTION

A quick disconnect system for a piece of construction equipment with an upper works rotatably supported on a lower works has been invented which overcomes the deficiencies noted above and has other advantages. The assembly is primarily for use with conventional swing bearings having an inner race and an outer race. The apparatus includes an adapter plate secured to either of the inner or outer race, the other race being secured to either the upper works or the lower works. The apparatus also includes means for releasably connecting the adapter plate to the other of the upper works or lower works.

In a preferred embodiment, a crane upper works sits on the adapter plate and is releasably connected to the adapter plate by links pinned at their upper end to the body of the upper works. A jacking bolt at the lower end of the link bears against the underside of the adaptor plate. The bearing outer race is secured to the bottom surface of the adapter plate. The bearing inner race is secured to the crane lower works, as in a conventional crane. When the crane is to be separated, the jacking bolt is loosened to allow the links to swing free of the adaptor plate. The upper works is then easily separated from the lower works. The adapter plate and bearing stay attached to the lower works. All of the bolts used to hold the bearing races are left intact and thus do not need to be retorqued when the crane is reassembled.

The invention has the advantage that it can use conventional bearings While there is an additional expense in providing the adapter plate and links, this is less expensive than many of the prior art special bearing designs. Further, with the preferred embodiment, the upper works carries no additional weight when the crane parts are separated. In fact, it may be possible to build the base of the upper works of lighter weight material when it is used with the adapter plate, reducing the weight of the heaviest piece of a disassembled crane.

These and other advantages of the invention, as well as the invention itself, will best be understood by reference to the attached drawings, a brief description of which follows.

DETAILED DESCRIPTION OF THE DRAWINGS AND PREFERRED EMBODIMENT OF THE INVENTION

Figure 1:
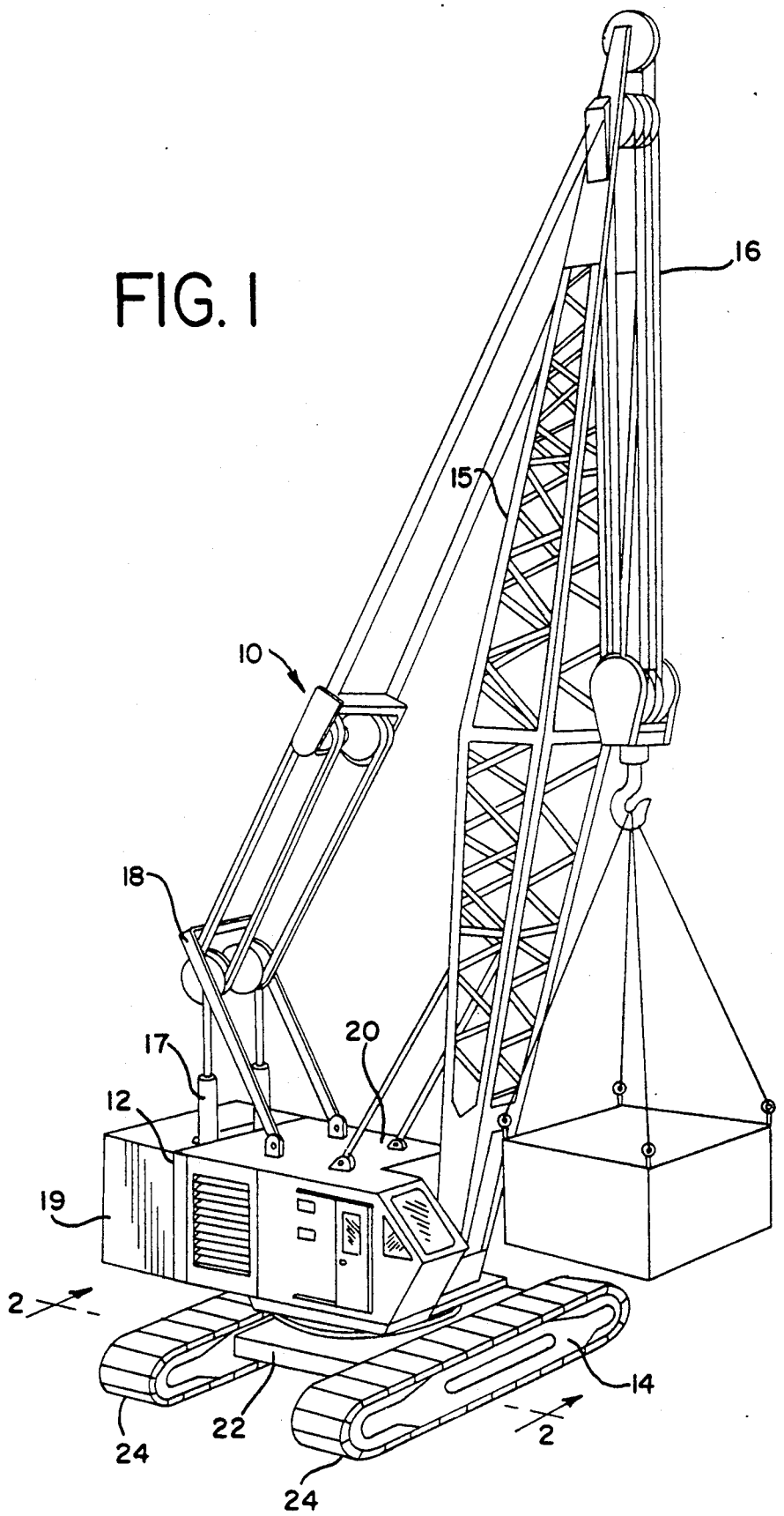
FIG. 1 is a perspective view of a crane incorporating the preferred embodiment of the present invention.

While the present invention will find application in all types of construction equipment, the preferred embodiment of the invention is described in conjunction with the crane 10 of FIG. 1. The crane 10 includes an upper works 12 rotatably supported on a mobile lower works 14. The upper works 12 and lower works 14 are conventional. The upper works 12 includes a boom 15 and rigging 16, backhitch 17, a gantry 18, counterweight 19 and power equipment (not shown) enclosed by a housing 20. The lower works 14 includes a body 22 and two independently powered crawler treads 24.

Figure 2:
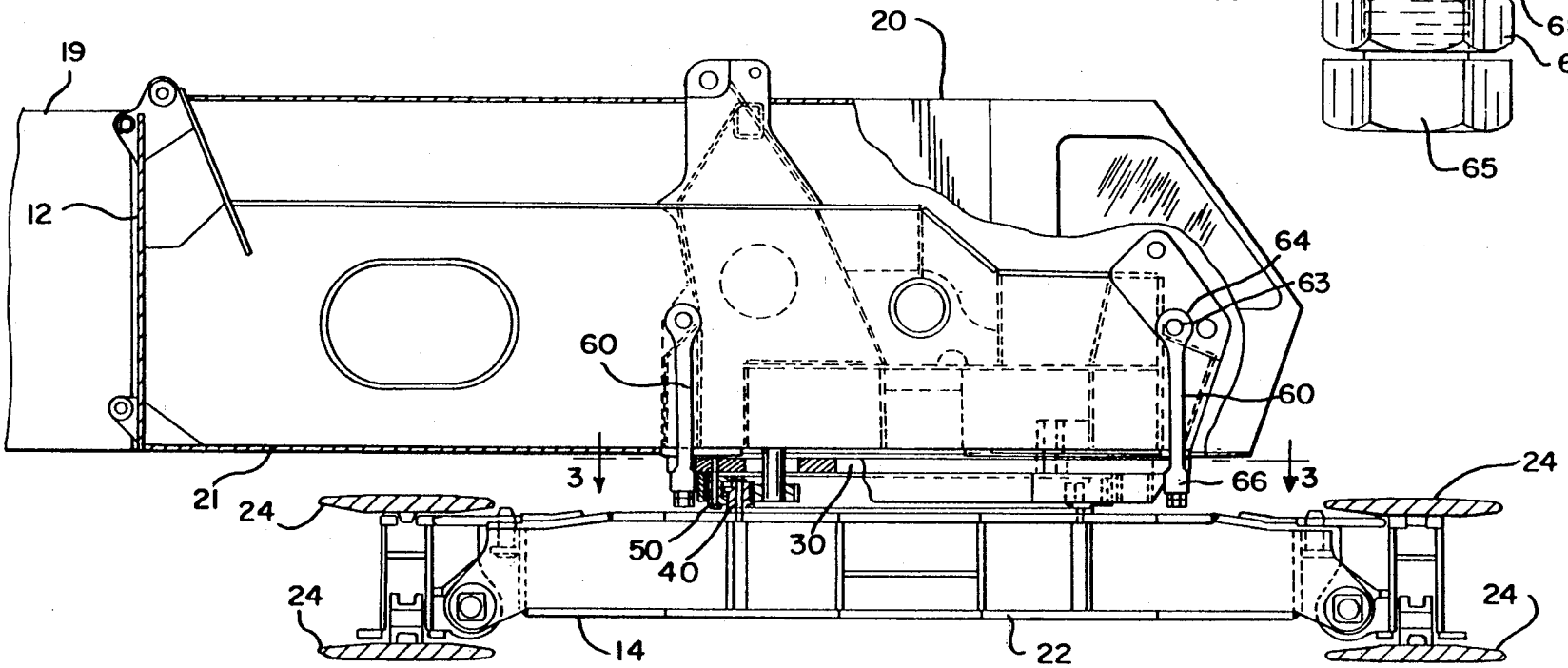
FIG. 2 is a sectional view taken along line 2—2 of FIG. 1.

As best seen in FIG. 2, in the crane 10 of the preferred embodiment, the upper works 12 is connected to the lower works 14 by a quick separation and assembly apparatus. The upper works 12 rests on an adapter plate 30, which in turn rests on a swing bearing 40. The bearing 40 in turn rests on the body 22 of the lower works 14. As described more fully hereafter, the adapter plate 30 is secured to the upper works 12 by means for releasably connecting the adapter plate 30 to the upper works 12. In the preferred embodiment shown, the releasably connecting means comprises links 60, shown in FIG. 2, pinned to the upper works 12. With the shape of the housing 20 shown in FIG. 1, the links 60 attach to the body of upper works 12 inside of the housing 20. Of course, where other housing shapes are used, the adaptor plate 30 may extend further than the housing 20, and the links 60 will then be visible outside of the housing 20.

Figure 4:
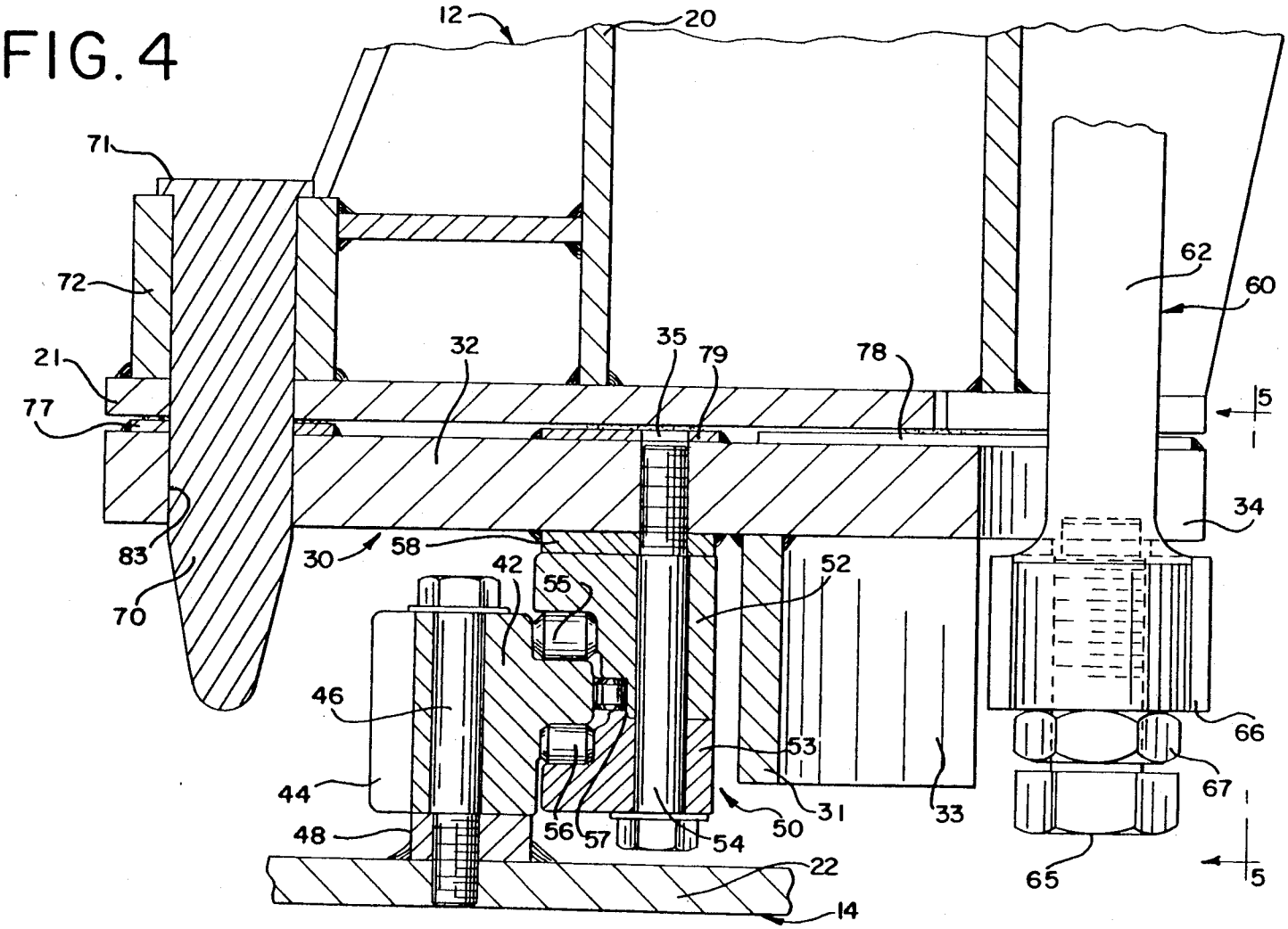
FIG. 4 is an enlarged sectional view taken along line 4—4 of FIG. 3.

The bearing 40, as best seen in FIG. 4, is of conventional design, with a one-piece inner race 42 having drive teeth 44 integrally formed thereon. The inner race 42 is bolted to the body 22 of the lower works 14 by torqued bolts 46. A finishing pad 48, machined to provide good vertical load transfer, sits between the body 22 and the inner race 42.

The outer race 50 is made of two pieces, upper member 52 and lower member 53. Torqued bolts 54 hold the two members 52 and 53 together and hold the outer race 50 to the adapter plate 30 Rollers 55, 56 and 57 ride between the inner race and the outer race. A finishing pad 58 rests between the outer race 50 and the adapter plate 30.

The adapter plate 30 of the preferred embodiment, as best seen in FIGS. 3, 3*a*, 3*b* and 4, comprises a generally rectangular plate member 32 with front tangs 34 and rear tangs 39 extending at its four corners. The adapter plate 30 has circular apertures 86 through plate 32 through which drive gears fit to engage the drive teeth 44. Those gears (not shown) are journaled in brackets mounted on the upper works 12. The power generating equipment of the crane 10 is used in a conventional manner to effectuate rotation of the upper works 12 relative to the lower works 14 via power transmitted through apertures 86. A larger aperture 87 in the adapter plate provides access for other power and control connections between the upper works 12 and the lower works 14.

A smaller circular aperture 83 is used to align the adapter plate 30 with the upper works 12. A pin 70 (FIG. 4) fits through a bushing 72 affixed to the floor 21 of the upper works 12, and through aperture 83. An annular shaped finishing pad 77 rests between the adapter plate 30 and the floor 21 of the upper works 12 surrounding aperture 83. Pin 70 has a head 71 that provides a shoulder to rest on bushing 72. Shear blocks 73 (FIG. 3, 3*a* and 3*b*) are welded onto the top of adapter plate 30 near rear tangs 39 on a part of the adaptor plate 30 so that the rear of the upper works 12 will fit between them. The pin 70 and shear blocks 73 transmit horizontal and torque loads between the upper works 12 and the adapter plate 30.

The adapter plate 30 also includes finishing pads 78 at each corner covering the tangs 34 and 39, and a finishing pad 79 covering about five-twelfths of the area over the outer race 50. Pad 79 is centered in the front portion of the adapter plate 30 Threaded holes 35 through the adapter plate 30, and through finishing pad 79, accommodate bolts 54.

Figure 3:
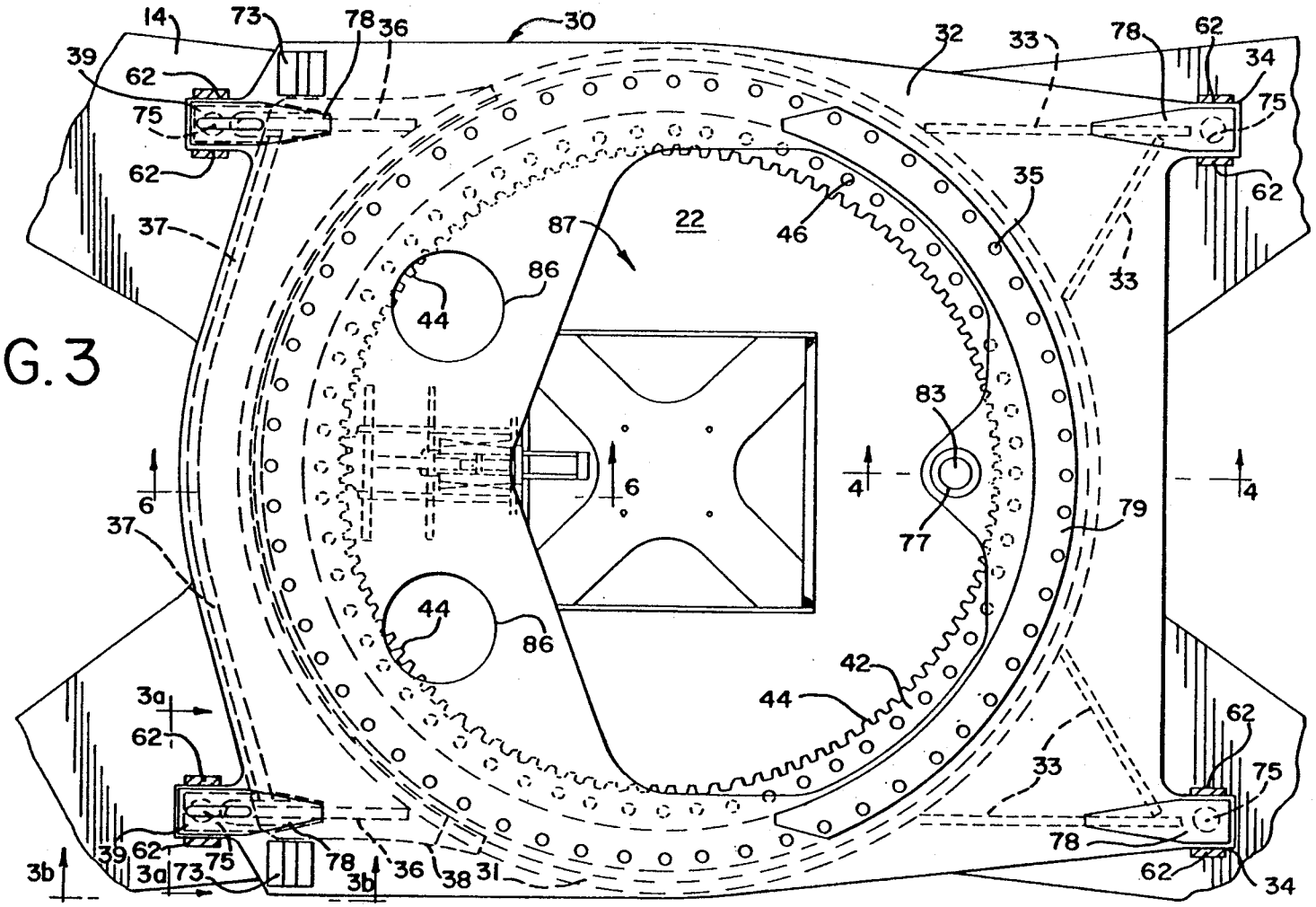
FIG. 3 is a sectional/plan view taken along line 3—3 of FIG. 2.
Figure 3B:
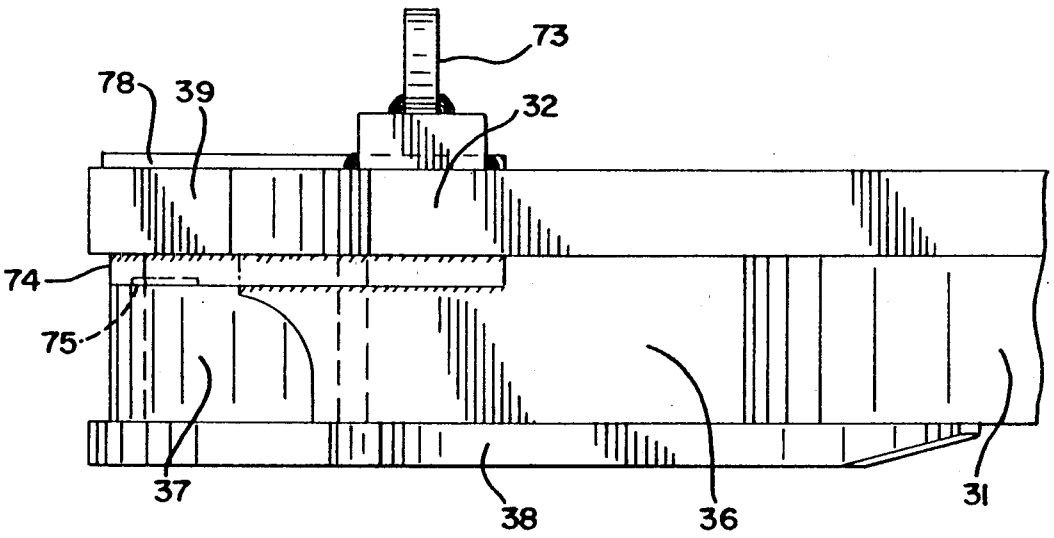
FIG. 3*b* is an enlarged plan view taken along line 3*b*—3*b* in FIG. 3.
Figure 3A:
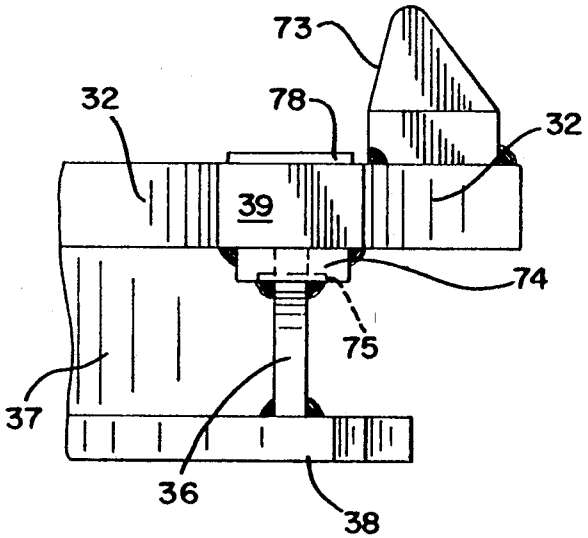
FIG. 3*a* is an enlarged plan view taken along line 3*a*—3*a* of FIG. 3.

The adapter plate 30 includes a circular reinforcing rib 31 concentric with and spaced outside of the outer race 50. The adapter plate 30 also includes a number of additional reinforcing ribs, including flat reinforcing ribs 33 extending from the circular reinforcing rib 31 to each of front tangs 34, flat reinforcing ribs 36 extending from the reinforcing rib 31 to the rear tangs 39, and an arcuate reinforcing rib 37 extending between rear tangs 39. Reinforcing ribs 31, 33, 36 and 37 are welded to the bottom of the adapter plate 30 to provide additional rigidity to the adapter plate 30. In the embodiment shown, additional plate material 38 is welded to the bottoms of the reinforcing ribs 31, 36 and 37 to form a box-like structure and add additional rigidity to the adapter plate 30. As best seen in FIGS. 3*a* and 3*b*, the bottom side of both of the rear tangs 39 is covered by a doubler plate 74 of high yield steel/ A counter bore 75 is made in the doubler plate 74 for attachment of the links 60, as explained below. (For clarity, links 60 are not shown in FIGS. 3*a* and 3*b*.)

Figure 5:
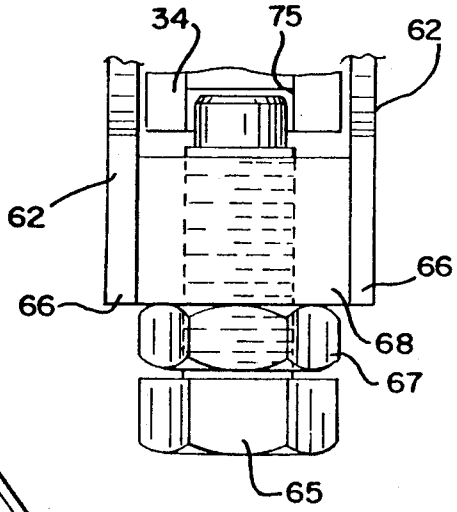
FIG. 5 is a sectional view taken along line 5—5 of FIG. 4.

The links 60, in conjunction with the pin 70 and shear blocks 73, releasably connect the adapter plate 30 to the upper works 12. Four links 60 are used, one at each corner of the adapter plate 30. As best seen in FIGS. 4 and 5, the links 60 each comprise two spaced apart pieces of steel strap 62, spanning between the point of the connection of the link 60 to the upper works 12 and the base of the link 60. Each strap 62 is wider at its ends than in its central section. The top end 64, best seen in FIG. 2, includes a hole for a pin 63 which is used to pin the straps 62 to the upper works 12. Cotter pins (not shown) hold the pins 63 in the upper works. The bottom end 66 is rectangular in shape As shown in FIG. 5, a base block 68 is welded between the rectangular ends of the straps 62. The straps 62 are spaced by the base block 68 so that the tangs 34 and 39 of adapter plate 30 fit between each set of straps 62. A jacking bolt 65 extends through the base block 68 and into the counter bore 75 of the doubler plate 74 on rear tangs 39. Similar counter bores 75 (FIG. 5) are formed in the underside of front tangs 34 for receiving jacking bolts 65 for the links 60 at the front of the adaptor plate. A jam nut 67 is used to prevent the bolt 65 from getting loose during crane operation. The weight of the upper works 12 and the tension in the links 60, transferred through the pins 63 and jacking bolts 65, holds the upper works 12 firmly onto the adapter plate 30.

Figure 6:
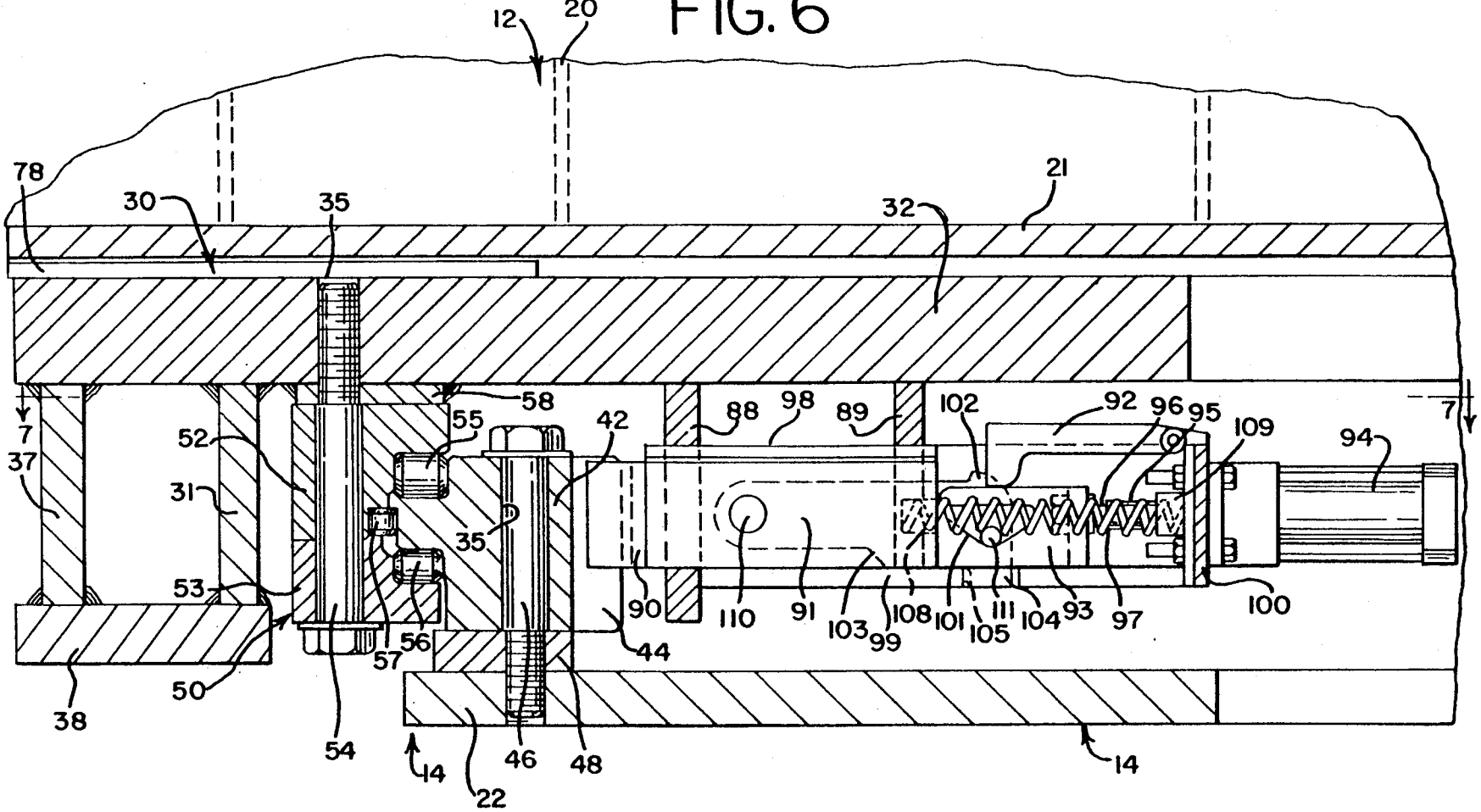
FIG. 6 is an enlarged, partial sectional view taken along line 6—6 of FIG. 3.
Figure 7:
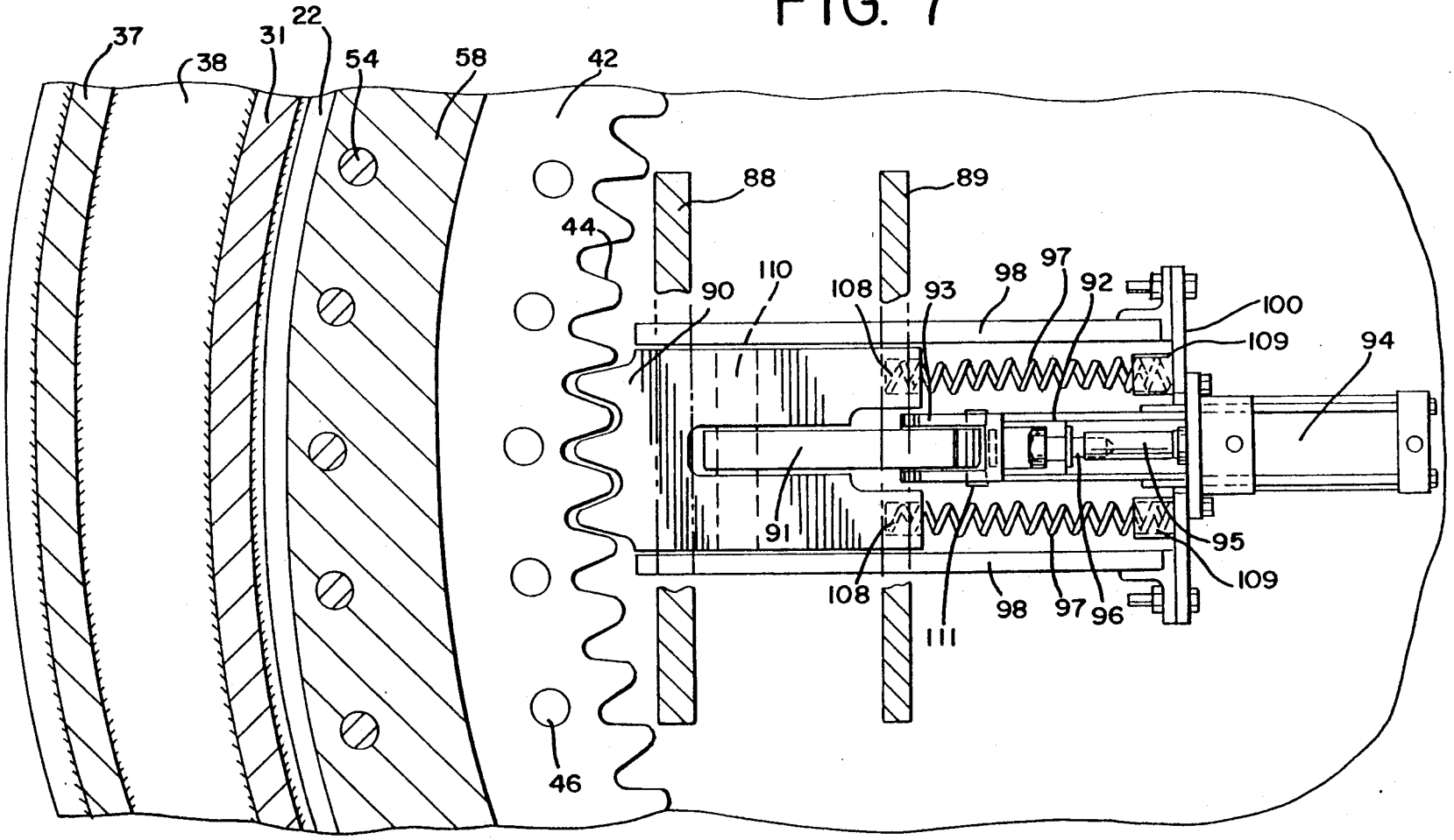
FIG. 7 is a partial sectional view taken along line 7—7 of FIG. 6.

A swing lock mechanism is used to prevent rotation of upper works 12 about the lower works 14 when the crane 10 is either not in operation, or used in a mode where rotation is to be avoided. A preferred swing lock mechanism for use in conjunction with the adapter plate 30 is shown in FIGS. 6 and 7. The mechanism is held to the underside of adapter plate 30 by welded plates 88 and 89.

The swing lock mechanism comprises a swing lock segment 90, a connector link 91, a latch 92, a rod end 93, an air cylinder 94 with a piston rod 95 to which the rod end 93 is attached by a bolt 96, side plates 98, a bottom plate 99 and end plate 100. Two return springs 97 are positioned between end plate 100 and swing lock segment 90. The ends of springs 97 are held in bores 108 in the end of swing lock segment 90 and cup members 109 fixed to end plate 100.

A pin 110 pivotly holds the connector link 91 to the swing lock segment 90. Swing lock segment 90 has three teeth which intermesh with drive teeth 44 on the inner race 40 when the piston 95 is extended to engage the swing lock mechanism. The rod end 93 is a clevis-shaped member which goes along both sides of the back of connector link 91. A downward pointing triangular slot 101 is formed horizontally in rod end 93. The slot 101 accepts a pin 111 fixed in the end of connector link 91 opposite pin 110.

The faces of rod end 93 oriented towards the drive teeth 44 are sloped forward at an approximate 60° angle. The top surface of connector link 91 includes a notch 102. The bottom surface of connector link 91 includes a leg 103 for sliding along the bottom plate 99, and terminates in a foot 104 which fits into a hole 105 formed in bottom plate 99, directly below the pin 111.

When the swing lock mechanism is to be disengaged, air cylinder 94 is activated to retract piston rod 95. This forces the rod end 93 to start moving toward end plate 100. As it does so, the pin 111 starts to ride up in slot 101, lifting foot 104 out of hole 105. Once pin 111 reaches the upper corner of slot 101, further retraction of piston rod 95 draws connector link 91, pin 110 and swing lock segment 90 away from drive teeth 44, compressing springs 97. When the swing lock mechanism is in its fully retracted position, latch 92, which is also clevis-shaped with its open end opposite the open section of rod end 93, falls over notch 102 of connector link 91 and rests against the sloped face of rod end 93. The latch 92 holds the swing lock segment 90 from engaging drive teeth 44 in case of failure of the pneumatic system.

When the swing lock mechanism is to be reengaged, air cylinder 94 is activated so as to force piston rod 95 outward. As piston rod 95 moves rod end 93 forward, latch 92 slides up the sloped face of rod end 93, disengaging notch 102 on connector 91. Return springs 97 are then free to push swing lock segment 90 back into an engaged position as shown in FIGS. 6 and 7. As connector 91 moves toward teeth 44, foot 104 is again free to drop into hole 105, which provides a rigid contact to keep the swing lock segment 90 engaged with drive teeth 44. Should drive teeth 44 not be lined up with the teeth on swing lock segment 90, the piston rod 95 is free to move to its fully extended position because the pin 111 can move to the back side of triangular slot 101. Once the teeth are aligned, springs 97 will force the swing lock segment 90 forward and rod end 93 will move to the position shown in FIG. 6.

The preferred embodiment of the quick disconnect system provides numerous advantages The crane 10 can be quickly disassembled by loosening jacking bolts 65, swinging links 60 free of the adaptor plate 30 and lifting upper works 12 off of the adapter plate 30. Reassembly is also rather simple, only requiring alignment of bushing 72 with aperture 83, drive gears with apertures 86 and the outside of upper works 12 between shear blocks 73. As shown in FIG. 4 and 3*a*, the lower end of pin 70 and the upper parts of shear blocks 73 are rounded to facilitate alignment.

Because of the rigidity of the adapter plate 30, it may be possible to reduce the thickness of the floor 21 and other members of the upper works 12, thus making the upper works 12 lighter. Most importantly, the quick disconnect system is relatively inexpensive because it uses conventional swing bearings, and may also therefore be interchangeable with other bearings on other crane parts. The adaptor plate 30 is particularly useful with swing bearings using rollers as shown, as well as ball-type swing bearings.

In the preferred embodiment of the crane 10, the various elements are made of steel, sized in accordance with good engineering design practice for the crane with which the adapter plate will be used. A preferred steel for the doubler plates 74 has a 100,000 psi yield.

Of course, a number of modifications may be made to the preferred embodiment disclosed above. For example, depending on the size of the crane, an additional pin such as pin 70, rather than shear blocks 73, may be required on the back of the adapter plate 30 to prevent twisting between the upper works 12 and the adapter plate 30. A hydraulic cylinder could be used in place of the air cylinder 94. In a less preferred embodiment, the adapter plate 30 could be releasably connected to the lower works, with the bearing and adapter plate 30 staying fixed to the upper works when the equipment is disassembled for transport.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

I claim:

1. A crane having an assembly for allowing quick separation of crane upper works from crane lower works comprising:

a) an adapter plate secured to the upper works by link members extending from the adapter plate to the body of the upper works;

b) one or more horizontal-load bearing pins extending through apertures in the base of the upper works and the adapter plate;

(c) a swing bearing first race bolted to the bottom of the adapter plate;

d) a swing bearing second race, with drive teeth integrally formed thereon, bolted to the lower works; and e) a swing lock mechanism actuatable into and out of a position wherein the mechanism engages the drive teeth of the second race to prevent rotation between the upper works and the lower works, the swing lock mechanism comprising:

(i) a swing lock segment comprising teeth adapted to intermesh with said teeth of said second race when the swing lock segment is in an engaged position, (ii) a piston actuatably mounted in a cylinder, the cylinder being secured to the upper works and the piston being connected to said swing lock segment so as to move said swing lock segment into and out of said engagement position upon actuation of the piston and cylinder, and (iii) a connector link connected to said swing lock segment, said connector link having a foot extending from one end thereof adapted to fit into a hole in a rigid portion of said swing lock mechanism when said swing lock segment is in its engaged position to thereby prevent the swing lock segment from disengagement when resisting a swing torque.

2. The crane of claim 1 wherein the adapter plate is generally rectangular and comprises four tangs, one of each extending from each corner of the adapter plate.

3. The crane of claim 2 wherein the links each comprise two strap members spaced so that the tangs fit between the straps and rest on a bolt extending through a block welded between the ends of the straps extending below the tangs.

4. The crane of claim 1 wherein the link members are pinned to the body of the upper works.

5. The crane of claim 1 further comprising shear blocks wherein said one or more horizontal-load bearing pins and shear blocks are adapted for transferring horizontal and torque loads between said upper works and said adapter plate.

6. The crane of claim 1 wherein the adapter plate comprises a plate member with apertures therethrough such that power generating means on the upper works can effectuate rotation of the upper work relative to the lower works.

7. The crane of claim 1 furthering comprising reinforcing ribs extending vertically downward from the bottom of the adapter plate.

8. The crane of claim 7 wherein the reinforcing ribs include a circular rib concentric with said swing bearing first race.

9. The crane of claim 1 further comprising finishing pads between the upper surface of the adapter plate and the upper works.

10. A swing lock mechanism for a crane having an upper works, a lower works, and a swing bearing connecting the upper works and the lower works so as to allow the upper works to be rotatable with respect to the lower works, the lower works further comprising a gear with teeth thereon for use in causing rotation of the upper works; the swing lock mechanism comprising:

a) a swing lock segment comprising teeth adapted to intermesh with aid gear teeth when the swing lock segment is in an engaged position, b) a piston actuatably mounted in a cylinder, the cylinder being secured to the upper works and the piston being connected to said swing lock segment so as to move said swing lock segment into and out of said engagement position upon actuation of the piston and cylinder, and c) a connector link connected to said swing lock segment, said connector link having a foot extending from one end thereof adapted to fit into a hole in a rigid portion of said swing lock mechanism when said swing lock segment is in its engaged position to thereby prevent the swing lock segment from disengagement when resisting a swing torque.

11. The swing lock mechanism of claim 10 further comprising at least one spring normally biased to force said swing lock segment into its engaged position.

12. The swing lock mechanism of claim 11 further comprising a latch to hold said swing lock segment in a disengaged position against the bias of said at least one spring until said latch is forced out of its latching position during reengagement of said swing lock segment.

13. The swing lock mechanism of claim 10 further comprising a slotted connection between the piston and the swing lock segment such that the piston can be in a fully extended position even if the teeth on the swing lock segment are not meshed with the gear teeth.

14. The swing lock mechanism of claim 10 further comprising two side plates extending downwardly on opposite sides of the swing lock segment and secured to said upper works such that the side plates prevent the upper works from rotating when said swing lock segment is in its engaged position.

15. The swing lock mechanism of claim 10 wherein the piston and cylinder comprise either an air cylinder or a hydraulic cylinder.

16. A crane having an assembly for allowing quick separation of crane upper works from crane lower works comprising:

a) an adapter plate secured to the upper works by link members extending from the adapter plate to the body of the upper works;

b) one or more horizontal-load bearing pins extending through apertures in the base of the upper works and the adapter plate;

c) finishing pads bearing between the upper surface of the adapter plate and the upper works;

d) a swing bearing outer race bolted to the bottom of the adapter plate;

e) a swing bearing inner race, with drive teeth integrally formed thereon, bolted to the lower works;

f) reinforcing ribs extending vertically downward from the bottom of the adapter plate; and g) shear blocks wherein said one or more horizontal-load bearing pins and shear blocks are adapted for transferring horizontal and torque loads between said upper works and said adapter plate.

* * * * *

UNITED STATES PATENT AND TRADEMARK OFFICE

CERTIFICATE OF CORRECTION

PATENT NO. : 5,176,267
DATED : January 5, 1993
INVENTOR(S) : David Pech

It is certified that error appears in the above-indentified patent and that said Letters Patent is hereby corrected as shown below:

In column 2, line 34, after "bearings" insert --.--.

In column 3, line 44, after "30" insert --.--.

In column 4, line 13, after "30" insert --.--.

In column 4, line 32, after "steel" delete "/" and insert --.-- therefor.

In column 4, line 48, after "shape" insert --.--.

In column 5, line 62, after "advantages" insert --.--.

Signed and Sealed this

Thirtieth Day of January, 1996

*Attest:*

*Attesting Officer*

BRUCE LEHMAN

*Commissioner of Patents and Trademarks*